US007977886B2

(12) United States Patent
Tsuda et al.

(10) Patent No.: US 7,977,886 B2
(45) Date of Patent: Jul. 12, 2011

(54) MERCURY-FREE DISCHARGE BULB

(75) Inventors: Toshiaki Tsuda, Shizuoka (JP); Takeshi Fukuyo, Shizuoka (JP); Shinichi Irisawa, Shizuoka (JP); Yukihiro Onoda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 112 days.

(21) Appl. No.: 12/472,730

(22) Filed: May 27, 2009

(65) Prior Publication Data

US 2009/0295287 A1 Dec. 3, 2009

(30) Foreign Application Priority Data

May 28, 2008 (JP) ..... 2008-139174

(51) Int. Cl.
*H01J 17/20* (2006.01)

(52) U.S. Cl. ..... 313/637; 315/248

(58) Field of Classification Search ..... 313/637; 315/248

See application file for complete search history.

(56) References Cited

U.S. PATENT DOCUMENTS 6,069,456 A * 5/2000 Fromm et al. ..... 315/248
2005/0082987 A1 * 4/2005 Uemura et al. ..... 313/637

FOREIGN PATENT DOCUMENTS

JP 2004-362978 A 12/2004

* cited by examiner

*Primary Examiner* — Nimeshkumar D Patel
*Assistant Examiner* — Mary Ellen Bowman
(74) *Attorney, Agent, or Firm* — Sughrue Mion, PLLC

(57) ABSTRACT

There is provided a mercury-free discharge bulb for a vehicle. The mercury-free discharge bulb includes an arc tube. The arc tube includes: a light-emitting portion which is formed of a ceramic tube and includes a light-emitting material and a starting xenon gas filled therein, wherein a filling pressure of the starting xenon gas from about 6 atm to about 18 atm; thin tube portions which are formed at respective ends of the light-emitting portion; and electrodes which are fixed inside the thin tube portions and which are provided in the light-emitting portion so as to face each other. The light-emitting material includes at least a sodium halide and a rare-earth metal halide excluding a scandium halide, and a difference between a vapor pressure of the sodium halide and a vapor pressure of the rare-earth metal halide under an environment of about 1000° C. is about 10 kPa or less.

6 Claims, 9 Drawing Sheets

FIG. 5A

| | NaI(kPa) |
|---|---|
| 400°C | 0.000 |
| 500°C | 0.000 |
| 600°C | 0.000 |
| 700°C | 0.001 |
| 800°C | 0.004 |
| 1000°C | 0.058 |

FIG. 5B

| | $CeI_3$(kPa) | $PrI_3$(kPa) | $DyI_3$(kPa) | $TmI_3$(kPa) | $HoI_3$(kPa) |
|---|---|---|---|---|---|
| 400°C | 0.000 | 0.000 | 0.000 | 0.000 | 0.000 |
| 500°C | 0.000 | 0.000 | 0.000 | 0.000 | 0.000 |
| 600°C | 0.000 | 0.000 | 0.000 | 0.000 | 0.000 |
| 700°C | 0.001 | 0.001 | 0.002 | 0.004 | 0.002 |
| 800°C | 0.026 | 0.040 | 0.050 | 0.083 | 0.039 |
| 1000°C | 3.944 | 6.316 | 6.583 | 10.002 | 5.863 |

FIG. 5C

| | $ScI_3$(kPa) |
|---|---|
| 400°C | 0.000 |
| 500°C | 0.000 |
| 600°C | 0.008 |
| 700°C | 0.330 |
| 800°C | 6.670 |
| 1000°C | 660.3 |

FIG. 6

| SAMPLE | IODIDE |
|---|---|
| C1 | Na:Sc:Zn=62:23:15 |
| E1 | Na:Ce:Zn=62:23:15 |
| E2 | Na:Ce:Tl:Zn=62:23:2:13 |
| E3 | Na:Ce:Tl:In:Zn=62:23:0.2:0.2:14.6 |
| E4 | Na:Ce:Tl:In:Dy=62:23:0.2:0.2:14.6 |

FIG. 7

| SAMPLE | | LUMINOUS FLUX | | | | | | | | CHROMATICITY | |
|---|---|---|---|---|---|---|---|---|---|---|---|
| | | 1(s) | | 4(s) | | 5(s) | | 100(%) | STABLE STATE | ymin | |
| | | lm | % | lm | % | lm | % | s | lm | x | y |
| C1 | Na+Sc+Zn | 759 | 20.7 | 886 | 24.1 | 1472 | 40.1 | 7.7 | 3672 | 0.266 | 0.260 |
| E1 | Na+Ce+Zn | 888 | 21.6 | 883 | 21.5 | 2167 | 52.7 | 6.1 | 4112 | 0.345 | 0.329 |
| E2 | Na+Ce+Tl+Zn | 928 | 21.2 | 902 | 20.7 | 2503 | 57.3 | 5.5 | 4368 | 0.338 | 0.341 |
| E3 | Na+Ce+Tl+In+Zn | 948 | 22.1 | 905 | 21.1 | 2570 | 60.0 | 5.8 | 4280 | 0.337 | 0.330 |
| E4 | Na+Ce+Tl+In+Dy | 959 | 21.7 | 945 | 21.4 | 2530 | 57.2 | 5.9 | 4425 | 0.343 | 0.338 |

FIG. 9

| SAMPLE | | AC LIGHTING | | | DC LIGHTING | | |
|---|---|---|---|---|---|---|---|
| | | ARC CURVE (mm) | HIGHEST TEMPERATURE OF ARC TUBE (°C) | INCIDENCE OF INITIAL DEFECT (%) | ARC CURVE (mm) | HIGHEST TEMPERATURE OF ARC TUBE (°C) | INCIDENCE OF INITIAL DEFECT (%) |
| E3 | Na+Ce+Tl+In+Zn | 0.89 | 1235 | 30 | 0.85 | 1248 | 42 |
| E4 | Na+Ce+Tl+In+Dy | 0.78 | 1125 | 0 | 0.71 | 1110 | 0 |

MERCURY-FREE DISCHARGE BULB

This application claims priority from Japanese Patent Application No. 2008-139174, filed on May 28, 2008, the entire contents of which are herein incorporated by reference.

BACKGROUND OF THE INVENTION

1. Technical Field

Apparatuses and devices consistent with the present invention relate to discharge bulbs, and more particularly, to mercury-free discharge bulbs used as a light source for an vehicle headlamp.

2. Related Art

A related art discharge bulb, which includes an arc tube made of glass, has been generally used as a light source of a vehicle headlamp. However, the glass tube of the arc tube is corroded by the filled light-emitting material (e.g., metal halide). The blackening or devitrification caused by this corrosion prevents the discharge bulb from obtaining an adequate light distribution, and accordingly a life span of a vehicle headlamp in which the related art discharge bulb is used is decreased.

JP-A-2004-362978 describes a related art discharge bulb including an arc tube. A light-emitting portion of the arc tube is formed of a ceramic tube. The arc tube is filled with a light-emitting material and starting noble gas, and thin tube portions formed at both ends of the light-emitting portion and electrode bars inserted into the thin tube portions are bonded by frit glass so as to maintain an airtight condition within the arc tube. The frit glass bond thus seals both ends of the light-emitting portion of the arc tube. Further, when the electrode bar is bonded to the thin tube portion, a minute gap communicating with the discharge arc chamber is formed between the inside of the thin tube portion and the electrode bar. Since the ceramic tube does not react much with the filled light-emitting material (e.g., metal halide), the life span of the arc tube body made of ceramic is longer than that of the arc tube made of glass.

The discharge arc chamber of the related art discharge bulb is generally filled with an alkali metal halide (e.g., sodium halide, NaI) and a rare-earth metal halide (e.g., scandium halide, $ScI_3$) as a main light-emitting material.

A discharge bulb for a vehicle headlamp naturally requires the quick rise of the luminous flux so that a predetermined luminous flux may be obtained directly after lighting. Accordingly, a starting performance of the discharge bulb is improved by filling the discharge bulb with a noble gas at high pressure as compared to a general discharge bulb. Further, the discharge bulb also requires that chromaticity is not significantly changed directly after lighting and when the discharge bulb is in a stable state. The related art discharge bulb described in JP-A-2004-362978 includes an arc tube that is formed of a cylindrical ceramic tube. Further, in order to form a compact bulb for an vehicle headlamp, the length of a region of the light-emitting portion is set in the range of 6 mm to 14 mm, the inner diameter of the light-emitting portion is set in the range of 1 mm to 3 mm, and the volume of an enclosed space is formed to be relatively small.

However, there are some disadvantages in the above-described related art discharge bulb. For example, even though the discharge arc chamber is filled with an appropriate amount of the light-emitting material, the luminous flux rises only slowly directly after lighting. Moreover, in the discharge bulb, the chromaticity changes widely from a time from directly after lighting until light emission becomes stable.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any disadvantages described above.

According to one or more aspects of the present invention, there is provided a mercury-free discharge bulb for a vehicle. The discharge bulb comprises an arc tube. The arc tube comprises a light-emitting portion which is formed of a ceramic tube and comprises a light-emitting material and a starting xenon gas filled therein, wherein a filling pressure of the starting xenon gas from about 6 atm to about 18 atm; thin tube portions which are formed at respective ends of the light-emitting portion; and electrodes which are fixed inside the thin tube portions and which are provided in the light-emitting portion so as to face each other. The arc tube is configured to satisfy a relationship of $2 \leqq Ea/Da \leqq 4$, in which Ea denotes a length of a region of the light-emitting portion and Da denotes an inner diameter of the light-emitting portion. A wall load value of the arc tube is about 45 $W/cm^2$ or more. The mercury-free discharge bulb is operated at a rated lamp power smaller than 35 W in an environment in which an inside temperature of the light-emitting portion is 1000° C. or higher. The light-emitting material comprises at least a sodium halide and a rare-earth metal halide, and excludes a scandium halide, and a difference between a vapor pressure of the sodium halide and a vapor pressure of the rare-earth metal halide under an environment of about 1000° C. is about 10 kPa or less.

BRIEF DESCRIPTION OF THE DRAWINGS

FIGS. 5A to 5C are tables showing a vapor pressure of a light-emitting material, wherein FIG. 5A is a table showing the vapor pressure of NaI, FIG. 5B is a table showing the vapor pressure of a rare-earth metal halide available for the discharge bulb, and FIG. 5C is a table showing the vapor pressure of $ScI_3$;

FIG. 6 is a table showing specifications of arc tubes according to Examples 1-4 and a Comparative Example;

FIG. 7 is a table showing lumen values and lowest values of chromaticity of discharge bulbs of the Comparative Example and Examples 1-4 in accordance with time;

FIG. 9 is a table showing comparative results of arc curves, a highest temperature of arc tubes, and incidences of initial defects of Examples 3 and 4.

DETAILED DESCRIPTION OF EXEMPLARY EMBODIMENTS OF THE INVENTION

Figure 1:
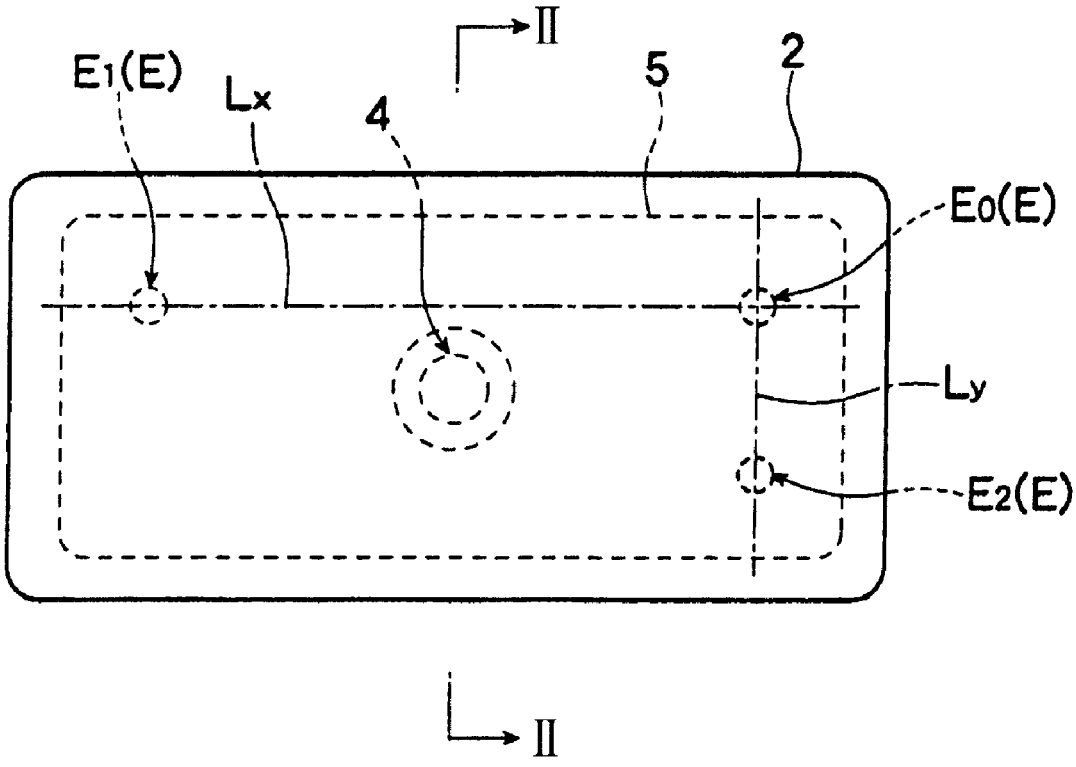
FIG. 1 is a longitudinal sectional view of a vehicle headlamp in which a discharge bulb is mounted.

In experimenting with the related art discharge bulb described in JP-A-2004-362978, it was found that the light-emitting material (i.e., the sodium halide and the rare-earth metal halide), which is evaporated in the discharge arc chamber, moves into the minute gap between the inside of the thin tube portion and the electrode bar, becomes cooled since the minute gap portion is the coolest point in the discharge arc chamber directly after lighting, and is liquefied or solidified so as to stay at the minute gap. Accordingly, the light-emitting material does not return to the discharge arc chamber and the amount of the main light-emitting material contributing to the light emission is substantially decreased.

In the related art discharge bulb, the discharge arc chamber is filled with a light-emitting material for adjustment (i.e., a metal halide for adjustment), which is separate from the main light-emitting material, in order to control a lamp voltage and the chromaticity in a stable state. However, in experimenting with the related art discharge bulb described in JP-A-2004-362978, it was found that an emission color of the light-emitting material for adjustment dominates the main light-emitting material, the latter of which is substantially reduced in the discharge arc chamber directly after lighting. In other words, a chromaticity directly after lighting is significantly different from a chromaticity at a time of stable light emission in which an emission color of the main light-emitting material is more prominently generated by the rise of the temperature of the entire arc tube.

Further, it was found that the above-described disadvantages of slow rise in luminous flux intensity and large change in chromaticity directly after lighting are worse when the discharge arc chamber is filled with $ScI_3$ as the main light-emitting material, as compared to when the discharge arc chamber is filled with other rare-earth metal halides as the main light-emitting material.

Since a mounting space of a discharge bulb used for an vehicle headlamp is limited, a light-emitting portion of the discharge bulb used for an vehicle headlamp is smaller than a light-emitting portion of a general discharge bulb, and the length of a region of the light-emitting portion and the inner diameter are decreased to only about several millimeters (i.e., a surface area of an inner wall of the discharge arc chamber is small). Accordingly, it was found that if this small discharge bulb is manufactured using a ceramic tube, an internal temperature of the discharge arc chamber directly after lighting reaches about 1000° C. Further, the pressure of NaI does not become high even under an environment of 1000° C., but the vapor pressure of $ScI_3$ (scandium halide) under an environment of 1000° C. is extremely high as compared to other rare-earth metal halides and reaches about 10000 times of the vapor pressure of NaI.

Accordingly, it was found that if the vehicle discharge bulb manufactured using a ceramic tube is filled with $ScI_3$ and is lighted, the $ScI_3$, whose pressure is increased directly after lighting, actively moves the NaI, and the temperature difference with respect to the thin tube portion (i.e., the coolest point after lighting) directly after lighting is increased by the significant rise of the temperature of the discharge arc chamber. Accordingly, the entire main light-emitting material including NaI is moved to the minute gap of the thin tube portion and remains in the minute gap.

Therefore, it was hypothesized that if the vapor pressure of the entire light-emitting material directly after lighting is suppressed so as not to become high, the light-emitting material will not remain in the minute gap but will stay at a lower portion (i.e., a portion below the arc generated between the electrodes) of the discharge arc chamber.

Specifically, in a discharge bulb according to an exemplary embodiment of the present invention, the discharge arc chamber is filled with NaI and a rare-earth metal halide of which the vapor pressure does not become high even under high temperature directly after lighting as the main light-emitting material, and a rise of the luminous flux directly after lighting and a change in chromaticity from directly after lighting to the stable state are measured.

An exemplary embodiment of the invention will now be described below with reference to Examples 1 to 4.

Figure 2:
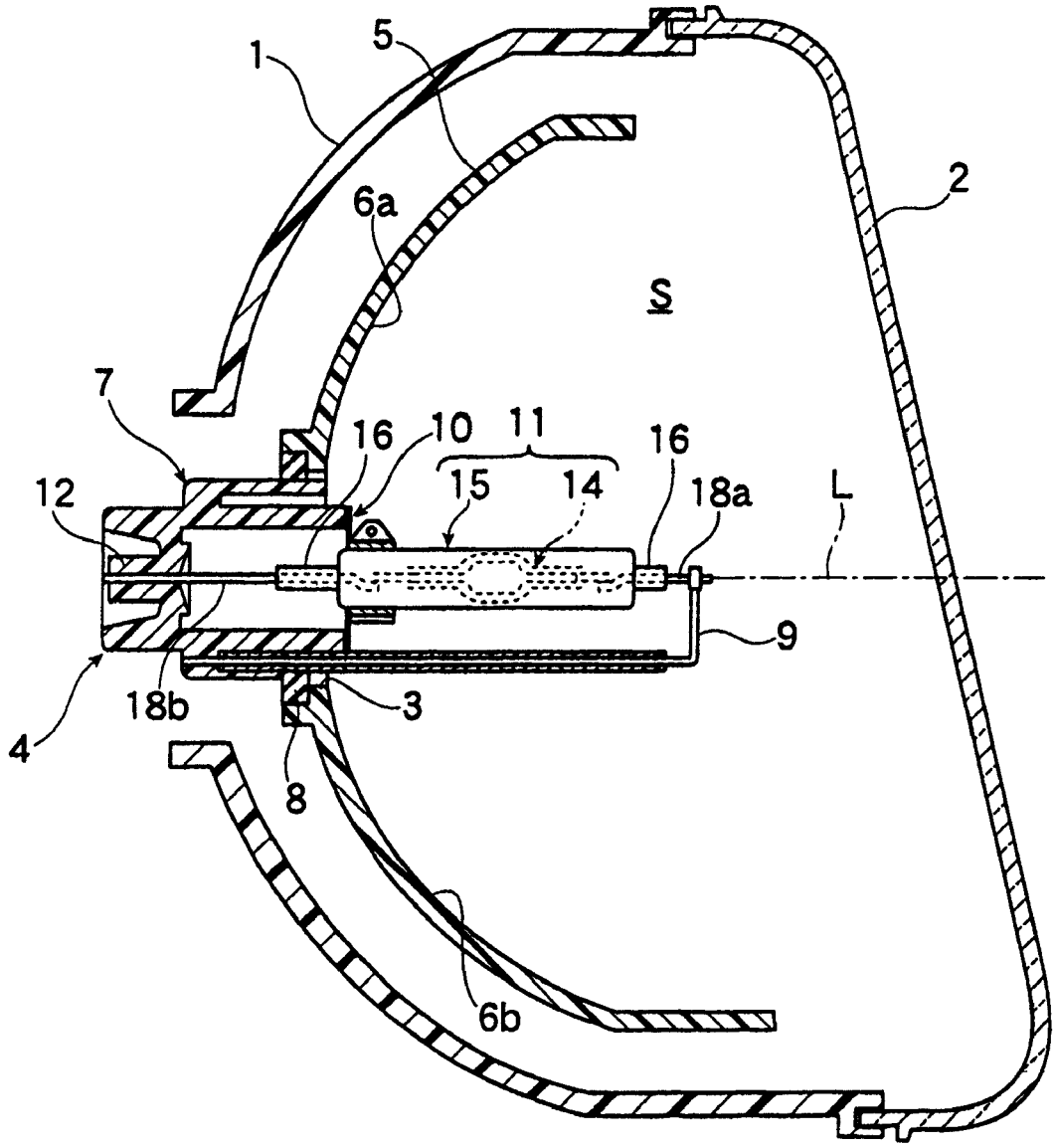
FIG. 2 is an axial sectional view taken along a line II-II of the vehicle headlamp of FIG. 1.
Figure 3:
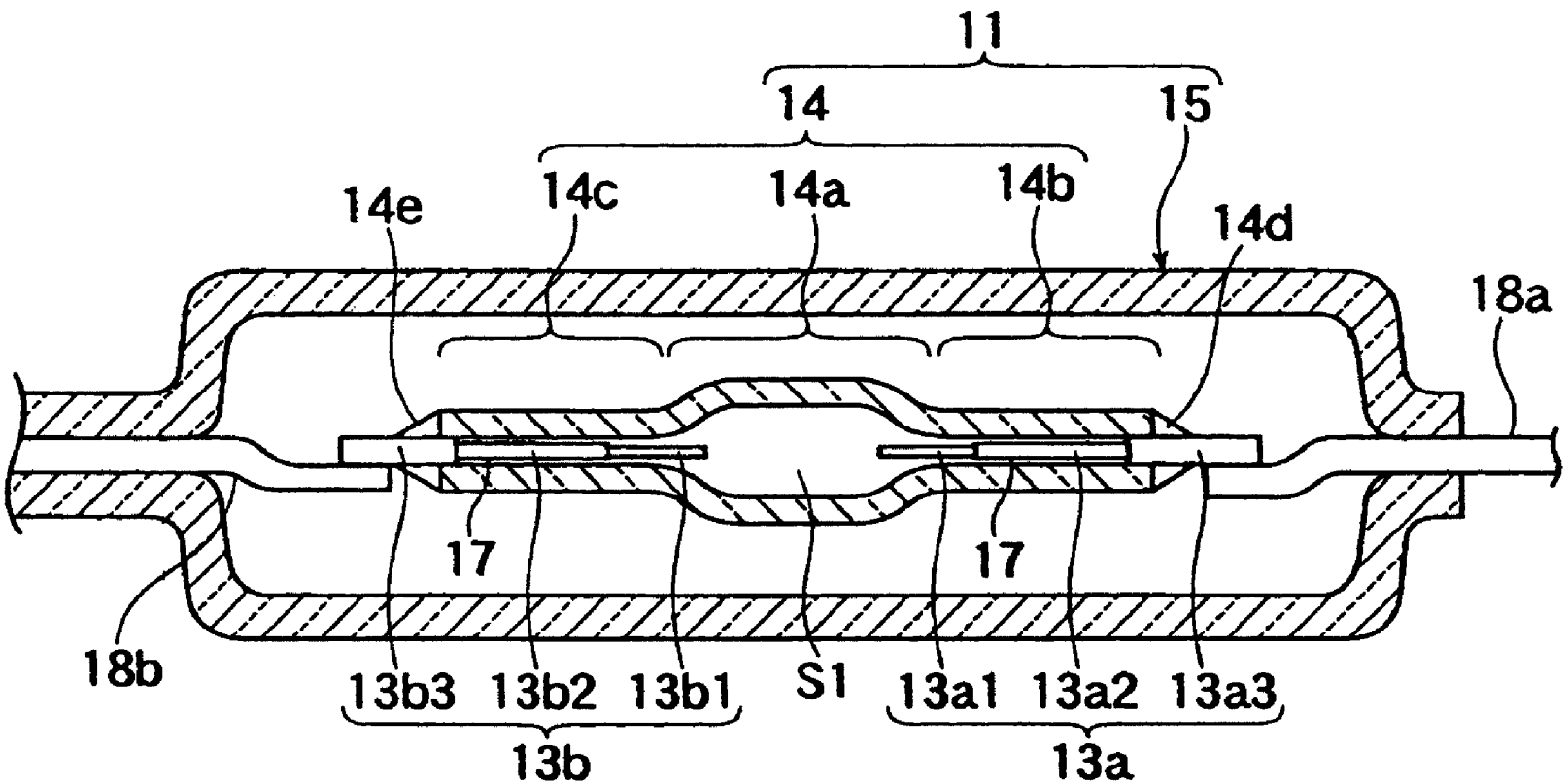
FIG. 3 is an enlarged axial sectional view of a capsule of a discharge bulb shown in FIG. 2.

Turning to FIGS. 1-3, a vehicle headlamp and discharge bulb according to an exemplary embodiment of the present invention is shown. Referring to FIG. 2, a vehicle headlamp is shown. The vehicle headlamp includes a lamp body 1, which is opened at the front side thereof, of a vessel-like vehicle headlamp. A front lens 2 is fitted to the front opening of the lamp body 1. Thus, a lamp chamber S is formed. A reflector 5 is provided in the lamp chamber S, and a discharge bulb 4 is inserted into a bulb insertion hole 3 formed at a rear apex of the reflector 5. Effective reflecting surfaces 6*a* and 6*b* and steps (not shown) for light distribution control are formed inside the reflector 5, so that the light emitted from the bulb 4 is reflected by the reflector 5 and travels toward the front side (i.e., through the front lens 2) of the vehicle headlamp. FIG. 1 shows a longitudinal sectional view of the vehicle headlamp. As shown in FIG. 1, an aiming mechanism E, which includes an aiming pivot E0 having one ball joint structure and two aiming screws E1 and E2, is provided between the reflector 5 and the lamp body 1 as shown in FIG. 1, so that an optical axis L of the reflector 5 can be tilted for aiming adjustment around a horizontal tilt axis Lx and a vertical tilt axis Ly.

Returning to FIG. 2, the discharge bulb 4 includes an insulating base 7, a focusing ring 8, a capsule 11, a lead support 9, and a supporting member 10. The insulating base 7 is made of a PPS resin. The focusing ring 8, which is fitted into the bulb insertion hole 3 of the reflector 5, is provided on the outer circumference of the insulating base 7. On the front side of the insulating base 7, the capsule 11 is supported between the lead support 9 that is made of metal and forms a conduction path extending forward from the front portion of the insulating base 7, and the support member 10 that is made of metal and is fixed to the front surface of the insulating base 7.

A lead wire 18*a*, which is led from a front end of the capsule 11, is fixed to a bent end of the lead support 9 extending from the insulating base 7 by spot welding, so that the front end of the capsule 11 is supported by the bent end of the lead support 9. A lead wire 18*b*, which is led from a rear end of the capsule 11, is connected to a terminal 12 that is provided at a rear end of the insulating base 7, and the rear end of the capsule 11 is supported by the support member 10 that is made of metal and is fixed to the front surface of the insulating base 7.

The capsule 11 includes an arc tube 14 and a cylindrical shroud glass 15 for intercepting an ultraviolet ray. The arc tube 14 and the shroud glass are integrally formed. Also, the arc tube 14 has a discharge arc chamber S1 in which electrodes 13*a* and 13*b* are provided so as to face each other, and the shroud glass covers the arc tube 14. The lead wires 18*a* and 18*b*, which are connected, respectively, to electrodes 13*a* and 13*b* that protrude into the discharge arc chamber S, are led from the front and rear ends of the arc tube 14. The shroud glass 15 for intercepting an ultraviolet ray is sealed to the lead wires 18*a* and 18*b*. Accordingly, the arc tube 14 is integrally formed with the shroud glass 15. A sealed portion 16 of the shroud glass 15 has a diameter which is less than the diameter of a center portion of the cylindrical shroud glass 15. An interior of the shroud glass 15 is in a vacuum or is filled with nitrogen gas or inert gas.

An enlarged view of the capsule 11 is shown in FIG. 3. The arc tube 14 includes a light-emitting portion 14*a* and thin tube portions 14*b* and 14*c* that are formed at respective ends of the light-emitting portion. The light-emitting portion 14*a* and the thin tube portions 14*b* and 14*c* are made of ceramic and are integrally formed. The discharge arc chamber S1 is formed inside the light-emitting portion 14*a*, and communicates with the thin tube portions 14*b* and 14*c*. The electrodes 13*a* and 13*b* are formed of bonded bodies, which include respective tungsten bars 13*a*1 and 13*b*1 formed at front ends thereof, respective molybdenum bars 13*a*2 and 13*b*2 formed in middle portions thereof, and respective niobium bars 13*a*3 and 13*b*3 formed at rear ends thereof, respectively. The electrodes 13*a* and 13*b* are inserted into the thin tube portions 14*b* and 14*c*, respectively.

The tungsten bars 13*a*1 and 13*b*1, which are formed at the front ends, respectively, of the inserted electrodes 13*a* and 13*b*, are provided in the discharge arc chamber S1 so as to face each other. Further, the niobium bars 13*a*3 and 13*b*3, which are formed, respectively, at the rear ends of the electrodes, are bonded to the respective ends of the thin tube portions 14*b* and 14*c* by frit glass fusing (i.e., a frit seal), and protrude into the shroud glass 15 so as to be bonded to the lead wires 18*a* and 18*b*.

Both ends of the thin tube portions 14*b* and 14*c* are sealed by the frit seal (sealed portions 14*d* and 14*e*, respectively), and minute gaps 17 are formed between the tungsten bars 13*a*1 and 13*b*1 and the respective inner portions of the thin tube portions 14*b* and 14*c* and between the molybdenum bars 13*a*2 and 13*b*2 and the respective inner portions of the thin tube portions 14*b* and 14*c*. The minute gaps 17 and the discharge arc chamber S1 form a communicating enclosed space. The discharge arc chamber S1 is filled with a main light-emitting material, a light-emitting material for adjustment, a starting noble gas, and the like.

Figure 4:
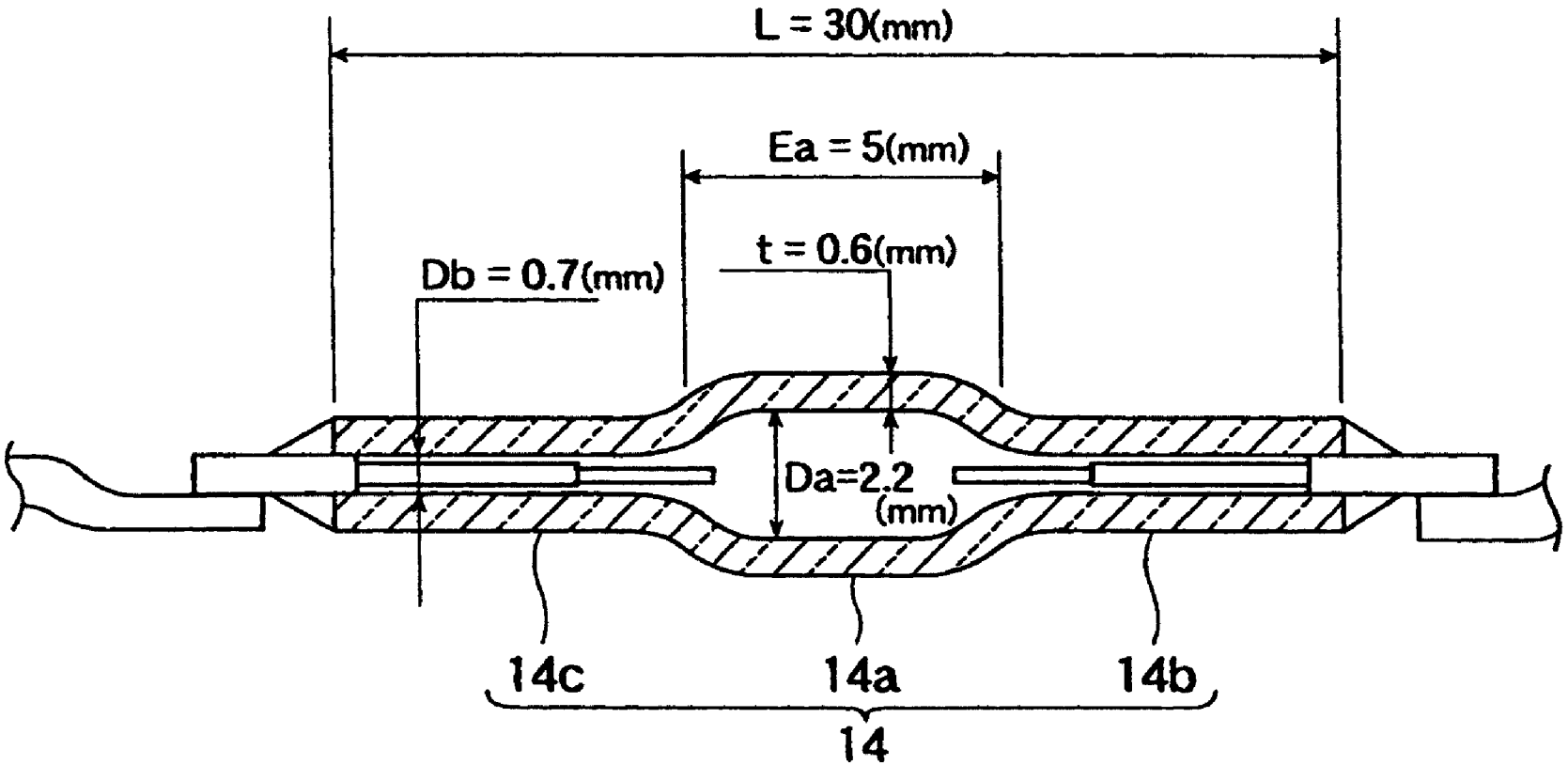
FIG. 4 is an enlarged axial sectional view of an arc tube of the discharge bulb of FIG. 3.

Since the discharge bulb is mounted to an vehicle headlamp, the discharge bulb is formed to have a small size in consideration of a storage space. In each Example, as shown in FIG. 4, the entire length L of the arc tube 14 is set to about 30 mm, the inner diameter Da of the light-emitting portion 14*a* is set to about 2.2 mm, the inner diameter Db of each of the thin tube portions 14*b* and 14*c* is set to about 0.7 mm, and the thickness t of each of the light-emitting portion 14*a* and the thin tube portions 14*b* and 14*c* is set to about 0.6 mm. Further, a ratio of the length Ea of the light-emitting portion 14*a* to the inner diameter Di of the light-emitting portion 14*a* satisfies a relationship $2 \leqq Ea/Di \leqq 4$. Thus, the length Ea of the light-emitting portion is set to about 5 mm in the Examples. If the discharge bulb is formed to have the above-mentioned size, the discharge bulb according to each Example is formed very compact.

The main light-emitting material used in each Example will be described below. The main light-emitting material contains sodium halide (NaI) that is an alkali metal halide, and a rare-earth metal halide. When the discharge bulb employing the ceramic tube of each Example emits light, temperature in the discharge arc chamber S1 reaches 1000° C. directly after lighting and rises in accordance with time. NaI (sodium halide) has been used for the arc tube of each Example. The vapor pressure of NaI begins to rise (to be evaporated) at about 700° C., and becomes 0.058 kPa under an environment of 1000° C. (see FIG. 5A). That is, exemplary embodiments of the present invention prevent a sudden rise of the vapor pressure of the main light-emitting material, which is filled in the discharge arc chamber S1, directly after lighting (i.e., under an environment of about 1000° C.). Accordingly, a rare-earth metal halide is used that has a vapor pressure not exceeding 10 kPa even though the vapor pressure of the rare-earth metal halide, which is filled in the discharge arc chamber S1 together with NaI, directly after lighting (that is, under an environment of 1000° C.) is higher than that of a sodium halide.

The rare-earth metal halides, which were employed for the arc tube of each Example, are shown in FIG. 5B. That is, in each Example, a rare-earth metal halide was filled in the discharge arc chamber S1 of FIG. 4, the temperature was increased 400° C. to 1000° C., and the vapor pressure was measured. As shown in FIG. 5B, the vapor pressure of $CeI_3$ (cerium halide) rises at about 700° C. and becomes 3.944 kPa under an environment of 1000° C. like NaI. Accordingly, a numerical value, which is obtained by subtracting a vapor pressure value of NaI from the vapor pressure value, satisfies "$CeI_3$–NaI=3.944 kPa–0.058 kPa=3.886 kPa" which thus does not exceed 10 kPa. Further, similarly to NaI, the vapor pressures of $PrI_3$ (praseodymium halide), $DyI_3$ (dysprosium halide), $TmI_3$ (thulium halide) and $HoI_3$ (holmium halide) rise at about 700° C. and becomes 6.316 kPa, 6.583 kPa, 10.002 kPa, and 5.683 kPa under an environment of 1000° C., respectively. Accordingly, the vapor pressure values of these rare-earth metal halides under an environment of 1000° C. are higher than the vapor pressure value (0.058 kPa) of NaI, but the difference therebetween does not exceed 10 kPa.

On the other hand, as shown in FIG. 5C, the rise of the vapor pressure of $ScI_3$ (scandium halide), which is caused by the rise of temperature is remarkable as compared to those of NaI and each of the rare-earth metal halides discussed above. That is, $ScI_3$ begins to be evaporated at about 600° C. The vapor pressure thereof reaches 660.3 kPa under an environment of 1000° C. and exceeds 10000 times of the vapor pressure of NaI. Accordingly, the vapor pressure of Sc (scandium) included in the main light-emitting material suddenly rises in the discharge arc chamber S1 directly after lighting, so that the entire evaporated main light-emitting material is actively moved. The entire evaporated main light-emitting material is moved to the minute gaps 17 of the thin tube portion 14, whose temperature is low directly after lighting, and remains in the minute gaps 17. Accordingly, the main light-emitting material, which emits light in the discharge arc chamber S1, is decreased. Therefore, in the following description, the cases where Sc is not included in the main light-emitting material (Examples 1 to 4) will be compared with a case where Sc is included in the main light-emitting material (Comparative Example).

That is, according to the exemplary embodiment, the arc tube of FIG. 4 was filled with respective iodides (halide) of Comparative Example ("C1" in the drawing) and Examples 1 to 4 ("E1" to "E4" in the drawing) shown in FIG. 6. Then, luminous flux and chromaticity generated directly after lighting were measured. As preconditions, the amount of each of the iodides to be filled was set to about 1 mg, and $N_2$ gas was filled between the arc tube 14 and the shroud glass 15 at 450 torr. Further, each of the iodides is a material that contains Na (sodium) as a main light-emitting material. When the temperature of the discharge arc chamber S1 exceeds 1000° C., the arc tube 14 was operated at a power smaller than 35 W, and the wall load value of the arc tube 14 was maintained at 45 $W/cm^2$ or more. Further, it is advantageous that the discharge arc chamber S1 be filled with Xe (xenon) gas at a filling pressure of 6 to 18 atm in consideration of the starting performance of the vehicle headlamp. Thus, in the case of the Comparative Example and the Examples 1-4, the discharge arc chamber S1 was filled with Xe gas at 10 atm.

Furthermore, the iodides of Examples 1 to 3 contain Ce (cerium) as a rare-earth metal forming the main light-emitting material, and were compared with a Comparative Example containing Sc (scandium). The iodide of Example 2, which is used for adjusting a voltage and chromaticity in a stable state, contains Zn (zinc) and Tl (thallium). The iodide of Example 3 contains In (indium) in addition to Zn and Tl of Example 2. The iodide of Example 4 contains Dy (dysprosium), Tl, and In, and contains Dy instead of Zn of Example 3. FIG. 6 shows the iodides and their respective numerical values for each of the Comparative Example and the Examples 1-4. The numerical values shown in FIG. 6 represent the content ratios of component materials for each of the iodides.

FIG. 7 is a table showing lumen values in a period from directly after lighting to a stable state, and showing chromaticity (x,y) when a y value is minimum. The respective lumen values were measured after 1 seconds (s), 4 s, and 5 s for each of the Examples 1 to 4 and the Comparative Example. In FIG. 7, "lm (lumen)" in the table denotes a lumen value, and "%" denotes a ratio (rounded off to one decimal place) compared to the lumen value in the stable light emission. Also, "100%" denotes a time (unit: seconds) which passed until the luminous flux of each Example reached a stable light emission. "STABLE STATE" denotes a lumen value at/after the stable light emission.

As shown in FIG. 7, when 1 second and 4 seconds pass after lighting, lumen values of Comparative Example and Examples 1 to 4 are about 20% of a lumen value in the stable state and are not significantly different between 1 second later and 2 seconds later. However, when 5 seconds pass after lighting, the lumen value of Comparative Example is 1472 (lm) that is 40.1% of 3672 (lm) (the lumen value in the stable state) and the lumen values of Examples 1 to 4 are 52.7% (Example 1), 57.3% (Example 2), 60.0% (Example 3), and 57.2 (Example 4) of lumen values in the stable state, respectively. Accordingly, the rise of the luminous flux of the discharge bulbs according to Examples 1 to 4 after 5 seconds pass from lighting are improved as compared to Comparative Example by approximately 12.6% to 19.9%. Further, the times, which pass until the luminous flux of the discharge bulbs according to Examples 1 to 4 reaches stable light emission, are 6.1, 5.5, 5.8, and 5.9 seconds, respectively, and are shorter by 1.6 to 2.2 seconds as compared to the time (7.7 seconds) of Comparative Example. Accordingly, the luminous flux of the discharge bulbs according to Examples 1 to 4 more quickly rises as compared to Comparative Example that includes Sc.

The lumen values of Examples 1 to 4 in the stable state are in the range of 4112 to 4425 (lm), and are thus larger than the lumen value (3672 (lm)) of Comparative Example by 400 or more (lm). Accordingly, the discharge bulbs according to Examples 1 to 4 include a larger amount of a main light-emitting material contributing to the light emission in the discharge arc chamber S1 even in the stable light emission as compared to the discharge bulb according to Comparative Example including Sc.

Figure 8:
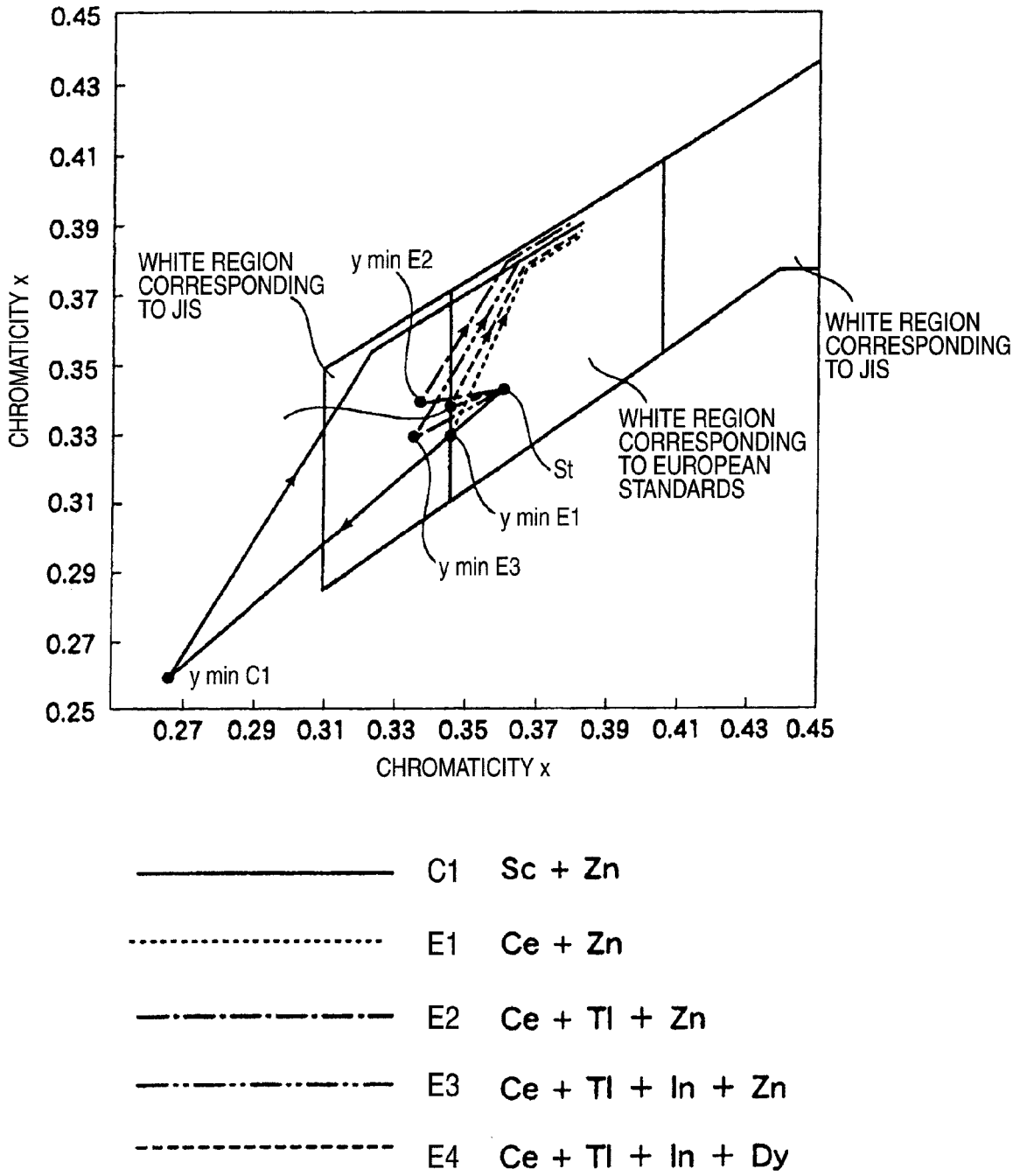
FIG. 8 is a graph showing a change in chromaticity of the Comparative Example and Examples 1-4 during a transition.

FIG. 8 is a graph showing the change in chromaticity of each of the discharge bulbs from a time directly after lighting until discharge becomes stable. A horizontal axis denotes chromaticity x, and a vertical axis denotes chromaticity y. In the drawing, a solid line C1, a broken line E1, a dashed line E2, and a two-dot chain line E3 denote the transition of chromaticity of Comparative Example and Examples 1 to 4, respectively. Further, a central portion of a substantially parallelogram-shaped frame, which is shown at the center of the drawing, represents a white region corresponding to European standards. A region of the frame including left, right, and central portions denotes a white region corresponding to JIS. It is advantageous for a discharge bulb, which is available for a vehicle headlamp, to satisfy a condition in which the chromaticity during lighting is in the range of the white region.

Accordingly, the measurement results as to whether the change in chromaticity of the discharge bulb is included in the above-mentioned range will now be described.

According to the measurement, the numerical value of the chromaticity of each discharge bulb substantially denoted by a position of "St" in the drawing directly after lighting, is decreased up to the position of "y min" together with x and y values, and is then increased together with x and y values. The numerical value of the chromaticity is increased up to a region close to an upper side of the parallelogram that represents the white region, and continues to be increased along the upper side of the parallelogram. After that, the increase of the numerical value of the chromaticity is stopped when light emission becomes stable.

That is, according to Example 1, the numerical value of y min, which is the minimum y, is "(x,y)=(0.345,0.329)", and the numerical value of chromaticity does not diverge from the white region corresponding to European standards until light emission becomes stable directly after lighting. Accordingly, chromaticity is changed but remains within in an allowable range of the European standards. Further, the numerical values of y min of Examples 2 to 4 are "(x,y)=(0.338,0.341)", "(x,y)=(0.337,0.330)", and "(x,y)=(0.343,0.338)", respectively, and diverge once from the white region corresponding to the European standards when the numerical value reaches y min directly after lighting. However, the numerical values of chromaticity, until light emission becomes stable after lighting, do not diverge from the white region corresponding to JIS. Accordingly, chromaticity of Examples 2 and 3 is changed in an allowable range of JIS. Therefore, the discharge bulbs according to Examples 1 to 4 have only a small change in chromaticity and thus might be used in the vehicle headlamp.

On the other hand, the numerical value of y min of the chromaticity of the discharge bulb according to Comparative Example is "(x,y)=(0.266,0.260)". Further, the numerical value of chromaticity significantly diverges from the white regions corresponding to European standards and JIS until the numerical value reaches y min after lighting, and a color similar to violet blue is shown at a position corresponding to y min. Accordingly, the discharge bulb according to Comparative Example has a large change in chromaticity unlike the discharge bulbs according to Examples 1-4.

Accordingly, the discharge bulbs according to Examples 1 to 4, which contain Ce (cerium) in the main light-emitting material, have a large rise of the luminous flux directly after lighting and small change in chromaticity as compared to the discharge bulb according to Comparative Example, which contain Sc (scandium) in the main light-emitting material. Accordingly, the discharge bulbs according to Examples 1-4 are better suited for use in the vehicle headlamp.

According to the exemplary embodiment, instead of Sc extremely increasing the internal pressure of the discharge arc chamber S1 under a temperature environment (under an environment of about 1000° C.) directly after lighting, a rare-earth metal Ce that has vapor pressure similar to the vapor pressure of Na under an environment of 1000° C. is contained in the iodide of the main light-emitting material together with Na. Accordingly, the discharge bulb of the vehicle headlamp has a larger rise of the luminous flux directly after lighting and smaller change in chromaticity. This is applied to cases where Pr (praseodymium), Dy (dysprosium), Tm (thulium) or Ho (holmium) having vapor pressure similar to the vapor pressure of Na under an environment of 1000° C. is contained in the iodide.

Moreover, the iodide of Example 4 has content ratios of component materials, that is, includes 20 to 30% by weight of $CeI_3$, 40 to 62% by weight of NaI, 13 to 36% by weight of $DyI_3$, 0 to 1% by weight of TlI, and 0.1 to 1.0% by weight of InI. However, Example 4 is obtained by substituting Zn, which is contained in the iodide of Example 3 (content ratios Na:Ce:Tl:In:Zn=62:23:0.2:0.2:14.6), with Dy at the same content ratio (14.6%). The numerical value of chromaticity of Example 4 is (0.343, 0.338) at y min, and is slightly larger than (0.337, 0.330) of Example 3, and is closer to the chromaticity in the stable light emission. Accordingly, the change in chromaticity of Example 4 is smaller than the change in chromaticity of the iodide of Example 3 during the rise.

In the discharge bulb according to exemplary embodiments of the vehicle headlamp, the arc tube is filled with xenon gas with high pressure, the shroud glass is in a vacuum, and the inner diameter of the discharge light-emitting portion is decreased to improve luminous efficacy and luminance. However, these parameters allow a temperature of the arc tube to rise by facilitating the contact between arc and the wall of the discharge arc chamber. Accordingly, if temperature exceeds enabled temperature, cracks or rupture are generated at the arc tube.

FIG. 9 is a table that compares arc curves, i.e., a distance of curved portions of the arc with respect to a straight line connecting the electrodes, when the bulbs according to Examples 3 and 4 are lighted for 1000 hours, the highest temperature of the arc tubes, and an incidence of initial defects (i.e., breakage rates of the arc tubes) for AC lighting and DC lighting.

As shown in FIG. 9, the arc curve of Example 4 was changed from 0.89 mm to 0.78 mm in the case of AC lighting, and was smaller than that of Example 3 by 0.11 mm. The arc curve was changed from 0.85 mm to 0.71 mm in the case of DC lighting, and was smaller than that of Example 3 by 0.14 mm. The highest temperature of the arc tube fell from 1235° C. to 1125° C., i.e., by 110° C., in the case of AC lighting and fell from 1248° C. to 1110° C., i.e., by 138° C., in the case of DC lighting. In this case, the initial defect rate of the bulb according to Example 3 was 30% in the case of AC lighting and 42% in the case of DC lighting, but the initial defect rate of the bulb according to Example 4 was improved up to 0% in the case of AC and DC lighting.

Accordingly, since the iodide of Example 4 contains Dy instead of Zn, the arc curve of Example 4 is decreased as compared to the iodide of Example 3 and the rise of the temperature of the arc tube is decreased as compared to Example 3. Accordingly, this is further advantageous in terms of the lengthening of the life span of a light emitting bulb.

Further, since the vapor pressure of Dy is lower than that of Zn at the same temperature, the violent collision of electrons against a positive electrode is suppressed during the DC lighting, so that the temperature difference between positive and negative electrodes is decreased. Accordingly, a phenomenon in which a halide is apt to stay at the negative electrode is improved due to the temperature difference. Thus, the color separation of the arc of the iodide of Example 4 is decreased as compared to that of Example 3. Therefore, the improvement of light-distribution performance is expected.

According to one or more aspects of the present invention, there is provided a mercury-free discharge bulb for a vehicle. The mercury-free discharge bulb comprises an arc tube comprising a light-emitting portion which is formed of a ceramic tube and comprising a light-emitting material and a starting xenon gas filled therein, wherein a filling pressure of the starting xenon gas is in the range of about 6 atm to about 18 atm; thin tube portions which are formed at both ends of the light-emitting portion; electrodes which are fixed inside the thin tube portions and which are provided in the light-emitting portion so as to face each other, wherein the arc tube is configured to satisfy the relationship of $2 \leqq Ea/Da \leqq 4$, where a length of a region of the light-emitting portion is Ea and an inner diameter of the light-emitting portion is Da, wherein a wall load value of the arc tube is 45 $W/cm^2$ or more, wherein the mercury-free discharge bulb is operated at a rated lamp power smaller than 35 W under an environment where an inside temperature of the light-emitting portion is 1000° C. or higher, wherein the light-emitting material comprises at least a sodium halide and a rare-earth metal halide excluding a scandium halide, and wherein a difference between a vapor pressure of the sodium halide and a vapor pressure of the rare-earth metal halide under an environment of about 1000° C. is about 10 kPa or less.

According to the discharge bulb described above, the vapor pressure of sodium halide (NaI) is low under an environment of about 1000°. Accordingly, the vapor pressure of a main light-emitting material is suppressed by filling the arc tube with NaI and a rare-earth metal halide, which has the difference of 10 kPa or less between the vapor pressure of NaI and the vapor pressure thereof and whose vapor pressure under an environment of about 1000° C. is similar to the vapor pressure of NaI, as a main light-emitting material, instead of filling a scandium halide, whose vapor pressure under the same environment is high, in the main light-emitting material. As a result, the movement of the main light-emitting material directly after lighting toward the thin tube portion is suppressed, so that the main light-emitting material does not stay at the minute gap in the thin tube portion but instead stays in the light-emitting portion. Accordingly, the main light-emitting material contributing to the light emission in the light-emitting portion is maintained without decrease.

According to one or more aspects of the present invention, the rare-earth metal halide comprises one or more metal halides selected from $CeI_3$ (cerium halide), $PrI_3$ (praseodymium halide), $DyI_3$ (dysprosium halide), $TmI_3$ (thulium halide), and a $HoI_3$ (holmium halide).

The vapor pressure of the rare-earth metal halides $CeI_3$, $PrI_3$, $DyI_3$, $TmI_3$, and $HoI_3$ is similar to the vapor pressure of sodium halide (NaI) under an environment of 1000° C., and the difference between the vapor pressures of the rare-earth metal halides and the vapor pressure of NaI is 10 kPa or less. As a result, the vapor pressure of the main light-emitting material is suppressed as a whole and the movement of the main light-emitting material directly after lighting toward the thin tube portion is suppressed, so that the main light-emitting material stays in the light-emitting portion and the main light-emitting material contributing to the light emission in the light-emitting portion is maintained without decrease.

According to one or more aspects of the present invention, the light-emitting portion is filled with one or more metal halides selected from an indium halide (InI), a zinc halide ($ZnI_2$), and a thallium halide (TlI).

The indium halide (InI), the zinc halide ($ZnI_2$), or the thallium halide (TlI), which is filled in the arc tube together with the main light-emitting material as the light-emitting material for adjustment, contributes to the adjustment of a lamp voltage, and/or the adjustment of chromaticity when the bulb stably emits light.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A mercury-free discharge bulb for a vehicle, the discharge bulb comprising:

an arc tube comprising:

a light-emitting portion which is formed of a ceramic tube and comprises a light-emitting material and a starting xenon gas filled therein, wherein a filling pressure of the starting xenon gas is in a range from about 6 atm to about 18 atm;

thin tube portions which are formed at respective ends of the light-emitting portion; and electrodes which are fixed inside the thin tube portions and which are provided in the light-emitting portion so as to face each other, wherein the arc tube is configured to satisfy a relationship of $2 \leqq Ea/Da \leqq 4$, in which Ea denotes a length of a region of the light-emitting portion and Da denotes an inner diameter of the light-emitting portion, a wall load value of the arc tube is about 45 $W/cm^2$ or more, the mercury-free discharge bulb is operated at a rated lamp power smaller than 35 W in an environment in which an inside temperature of the light-emitting portion is 1000° C. or higher, the light-emitting material comprises at least a sodium halide and a rare-earth metal halide, and excludes a scandium halide, and a difference between a vapor pressure of the sodium halide and a vapor pressure of the rare-earth metal halide under an environment of about 1000° C. is about 10 kPa or less.

2. The mercury-free discharge bulb according to claim 1, wherein the rare-earth metal halide comprises one or more metal halides selected from a cerium halide, a praseodymium halide, a dysprosium halide, a thulium halide, and a holmium halide.

3. The mercury-free discharge bulb according to claim 1, wherein the light-emitting portion is filled with one or more metal halides selected from an indium halide, a zinc halide, and a thallium halide.

4. The mercury-free discharge bulb according to claim 1, wherein the rare-earth metal halide comprises a cerium halide.

5. The mercury-free discharge bulb according to claim 1, wherein a respective gap is formed between each thin tube portion and a respective electrode such that the light emitting material enters the gap.

6. The mercury-free discharge bulb according to claim 1, wherein the light-emitting material essentially consists of a sodium halide, a cerium halide and a dysprosium halide.

* * * * *